US010577936B2

(12) United States Patent
Lewis et al.

(10) Patent No.: US 10,577,936 B2
(45) Date of Patent: Mar. 3, 2020

(54) MATEFACE SURFACES HAVING A GEOMETRY ON TURBOMACHINERY HARDWARE

(71) Applicant: United Technologies Corporation, Hartford, CT (US)

(72) Inventors: Scott D. Lewis, East Hartford, CT (US); John W. Magowan, East Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 341 days.

(21) Appl. No.: 14/914,762

(22) PCT Filed: Aug. 21, 2014

(86) PCT No.: PCT/US2014/052114

§ 371 (c)(1),
(2) Date: Feb. 26, 2016

(87) PCT Pub. No.: WO2015/031160

PCT Pub. Date: Mar. 5, 2015

(65) Prior Publication Data

US 2016/0201469 A1 Jul. 14, 2016

Related U.S. Application Data

(60) Provisional application No. 61/872,151, filed on Aug. 30, 2013.

(51) Int. Cl.
*F01D 5/14* (2006.01)
*F01D 5/02* (2006.01)
(Continued)

(52) U.S. Cl.
CPC ..... *F01D 5/141* (2013.01); *F01D 5/02* (2013.01); *F01D 5/081* (2013.01); *F01D 5/18* (2013.01);
(Continued)

(58) Field of Classification Search
CPC ... F01D 5/02; F01D 5/081; F01D 5/18; F01D 9/041; F01D 11/006; F05D 2240/123;
(Continued)

(56) References Cited

U.S. PATENT DOCUMENTS 5,967,745 A * 10/1999 Tomita ..... F01D 11/001 415/173.7
6,910,854 B2 * 6/2005 Joslin ..... F01D 5/225 415/139
(Continued)

FOREIGN PATENT DOCUMENTS

EP 1840333 A1 10/2007

OTHER PUBLICATIONS

International Search Report for Application No. PCT/US2014/052114; International Filing Date: Aug. 21, 2014; dated Dec. 1, 2014; 3 pgs.
(Continued)

*Primary Examiner* — Dwayne J White
*Assistant Examiner* — Behnoush Haghighian
(74) *Attorney, Agent, or Firm* — Cantor Colburn LLP

(57) ABSTRACT

Turbomachinery hardware, used in a rotor assembly and a stator assembly, including an airfoil portion including a leading edge, a trailing edge, a pressure side, and a suction side, and a platform on which the airfoil portion is disposed. The platform including a platform axis, a pressure side mateface located adjacent to the pressure side of the airfoil portion and a suction side mateface located adjacent to the suction side airfoil portion, wherein a portion of a pressure
(Continued)

side mateface includes a first geometry, and a portion of a suction side mateface includes a second geometry. The first geometry is selected from a group consisting of: oblique to a platform axis, and a first curved portion. The second geometry is selected from a group consisting of: oblique to the platform axis and a second curved portion.

10 Claims, 7 Drawing Sheets

(51) Int. Cl.

| | |
|---|---|
| ***F01D 5/18*** | (2006.01) |
| ***F01D 9/04*** | (2006.01) |
| ***F01D 25/12*** | (2006.01) |
| ***F01D 5/08*** | (2006.01) |
| *F01D 5/22* | (2006.01) |
| *F01D 11/00* | (2006.01) |

(52) U.S. Cl.
CPC ..... *F01D 9/041* (2013.01); *F01D 25/12* (2013.01); *F01D 5/143* (2013.01); *F01D 5/22* (2013.01); *F01D 5/225* (2013.01); *F01D 11/005* (2013.01); *F01D 11/006* (2013.01); *F05D 2220/32* (2013.01); *F05D 2240/123* (2013.01); *F05D 2240/124* (2013.01); *F05D 2240/305* (2013.01); *F05D 2240/306* (2013.01); *F05D 2240/80* (2013.01); *F05D 2240/81* (2013.01); *F05D 2250/32* (2013.01); *F05D 2250/71* (2013.01); *F05D 2260/221* (2013.01)

(58) Field of Classification Search
CPC ..... F05D 2240/124; F05D 2240/305; F05D 2240/306; F05D 2240/80; F05D 2240/81; F05D 2250/32; F05D 2250/71; F05D 2260/221
See application file for complete search history.

(56) References Cited

U.S. PATENT DOCUMENTS

| | | | | |
|---|---|---|---|---|
| 8,128,349 | B2 * | 3/2012 | Lutjen | F01D 11/08 415/173.1 |
| 8,206,114 | B2 | 6/2012 | Spangler et al. | |
| 8,382,424 | B1 | 2/2013 | Liang | |
| 8,961,135 | B2 * | 2/2015 | Beeck | F01D 5/143 416/193 A |
| 9,175,567 | B2 * | 11/2015 | Aggarwala | F01D 5/143 |
| 2007/0110580 | A1 * | 5/2007 | Tibbott | F01D 5/081 416/193 A |
| 2009/0269184 | A1 * | 10/2009 | Spangler | F01D 5/187 415/115 |
| 2010/0124508 | A1 | 5/2010 | Liang | |
| 2012/0230826 | A1 | 9/2012 | Raible | |
| 2013/0004315 | A1 | 1/2013 | Beeck et al. | |

OTHER PUBLICATIONS

International Written Opinion for Application No. PCT/US2014/052114; International Filing Date: Aug. 21, 2014; dated Dec. 1, 2014; 11 pgs.
European Search Report for Application No. 14840790.1-1610; dated Mar. 1, 2017; 6 pgs.

* cited by examiner

MATEFACE SURFACES HAVING A GEOMETRY ON TURBOMACHINERY HARDWARE

CROSS REFERENCE TO RELATED APPLICATIONS

The present application is related to, and claims the priority benefit of, U.S. Provisional Patent Application Ser. No. 61/872,151 filed Aug. 30, 2013, the contents of which are hereby incorporated in their entirety into the present disclosure.

TECHNICAL FIELD OF THE DISCLOSED EMBODIMENTS

The presently disclosed embodiments generally relate to gas turbine engines and, more particularly, to mateface surfaces having a geometry on turbomachinery hardware.

BACKGROUND OF THE DISCLOSED EMBODIMENTS

Turbine blade and vane platforms, from which blade and vane airfoil portions extend, can experience platform distress due to lack of adequate cooling. Hot gaspath air impinges on the downstream mateface wall, which augments the heat transfer and then penetrates the entire depth of the mateface. When this occurs, turbine blade and vane platforms experience localized heavy distress, such as thermo-mechanical fatigue (TMF), and oxidation. Turbine blades can experience the additional distress mode of creep. Such distress often occurs in regions where the airfoil trailing edge is in close proximity to the mateface. These regions are particularly difficult to cool because the platform edges are a considerable distance from the blade and vane core. This presents a manufacturing challenge in drilling long cooling holes into a region where limited space is available. There is therefore a need to reduce the penetration of gaspath air into the mateface regions, utilizing minimal cooling flow, in order to reduce turbine blade and vane platform distress.

BRIEF SUMMARY OF THE DISCLOSED EMBODIMENTS

In one aspect, a turbomachinery hardware for a turbine assembly in a gas turbine engine of the present disclosure is provided. The turbomachinery hardware includes a platform that supports an airfoil. The airfoil includes a leading edge, a trailing edge, a pressure side, and a suction side. Each platform includes a pressure side mateface, a suction side mateface, and a platform axis. In one embodiment, each turbomachinery hardware includes at least one interior cooling passage disposed within the blade platform.

In one embodiment, at least a portion of the pressure side mateface includes a first geometry oblique to the platform axis. In one embodiment the first geometry includes an angle of less than 90 degrees formed between the pressure side mateface and the platform axis. In one embodiment the first geometry includes an angle between approximately 25 degrees and approximately 65 degrees formed between the pressure side mateface and the platform axis.

In another embodiment, the first geometry includes a first curved portion. In one embodiment, the first geometry further includes a first straight portion adjacent to the first curved portion. In one embodiment, an angle of less than or equal to 90 degrees is formed between the first straight portion of the pressure side mateface and the platform axis. In one embodiment, an angle between approximately 25 degrees and approximately 65 degrees is formed between the first straight portion of the pressure side mateface and the platform axis.

In one embodiment, at least a portion of the suction side mateface includes a second geometry oblique to the platform axis. In one embodiment the second geometry comprises an angle of less than 90 degrees formed between the suction side mateface and the platform axis. In one embodiment the second geometry comprises an angle between approximately 25 degrees and approximately 65 degrees formed between the suction side mateface and the platform axis.

In another embodiment, the second geometry includes a second curved portion. In one embodiment, the second geometry further includes a second straight portion adjacent to the second curved portion. In one embodiment, an angle of less than or equal to 90 degrees is formed between the second straight portion of the suction side mateface and the platform axis. In one embodiment, an angle between approximately 25 degrees and approximately 65 degrees is formed between the second straight portion of the suction side mateface and the platform axis.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

Figure 1:
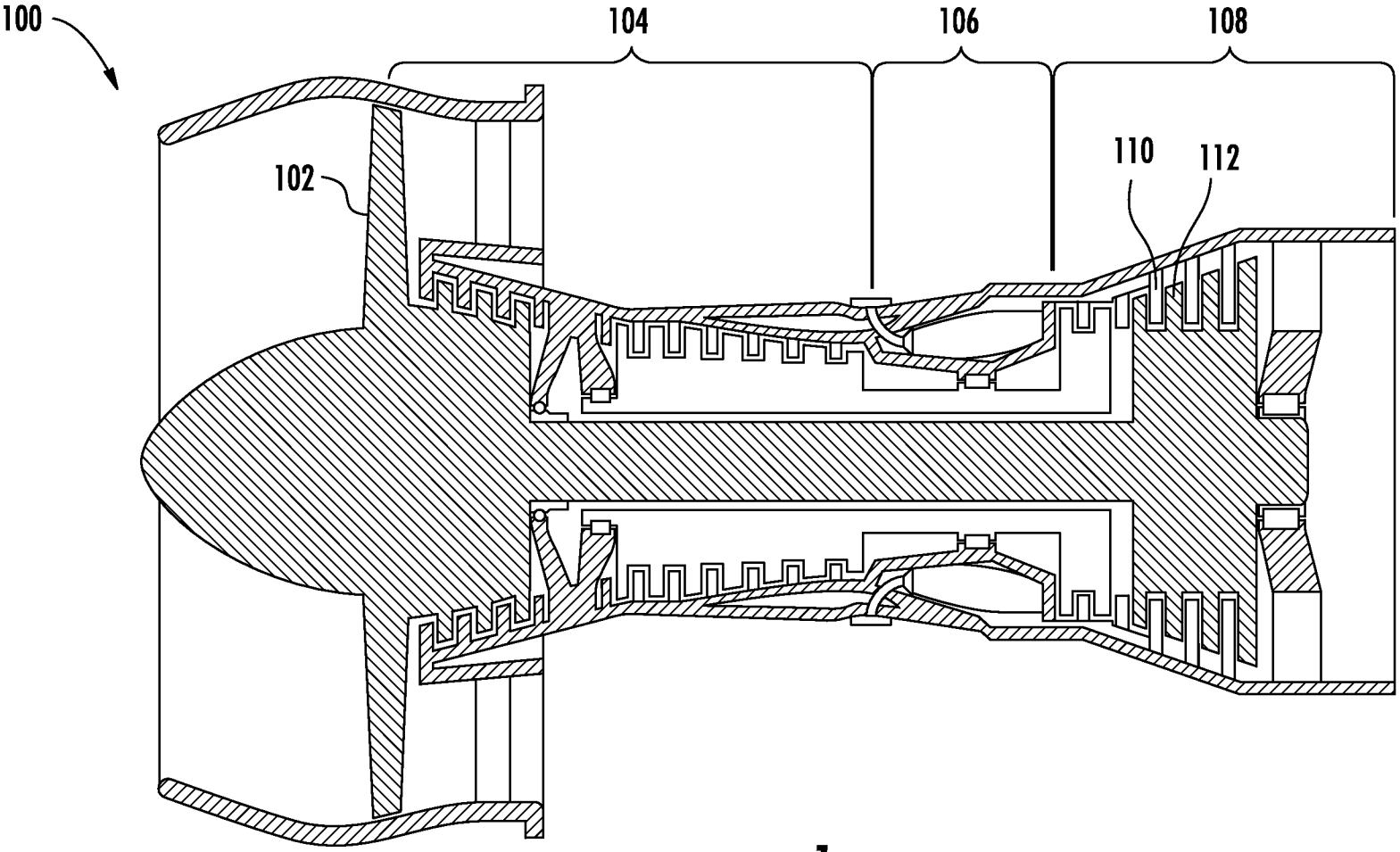
FIG. 1 is a general schematic view of a gas turbine engine as an exemplary application of the described subject matter.

An overview of the features, functions and/or configuration of the components depicted in the figures will now be presented. It should be appreciated that not all of the features of the components of the figures are necessarily described. Some of these non-discussed features, as well as discussed features are inherent from the figures. Other non-discussed features may be inherent in component geometry and/or configuration.

DETAILED DESCRIPTION OF THE DRAWINGS

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a gas turbine engine 100. As shown in FIG. 1, engine 100 is depicted as a turbofan that incorporates a fan 102, a compressor section 104, a combustion section 106 and a turbine section 108. Turbine section 108 includes alternating sets of a stator assembly including a plurality of stationary vanes 110 arranged in a circular array and a rotor assembly including a plurality of blades 112 arranged in a circular array. Although depicted as a turbofan gas turbine engine, it should be understood that the concepts described herein are not limited to use with turbofans as the teachings may be applied to other types of gas turbine engines.

Figure 2:
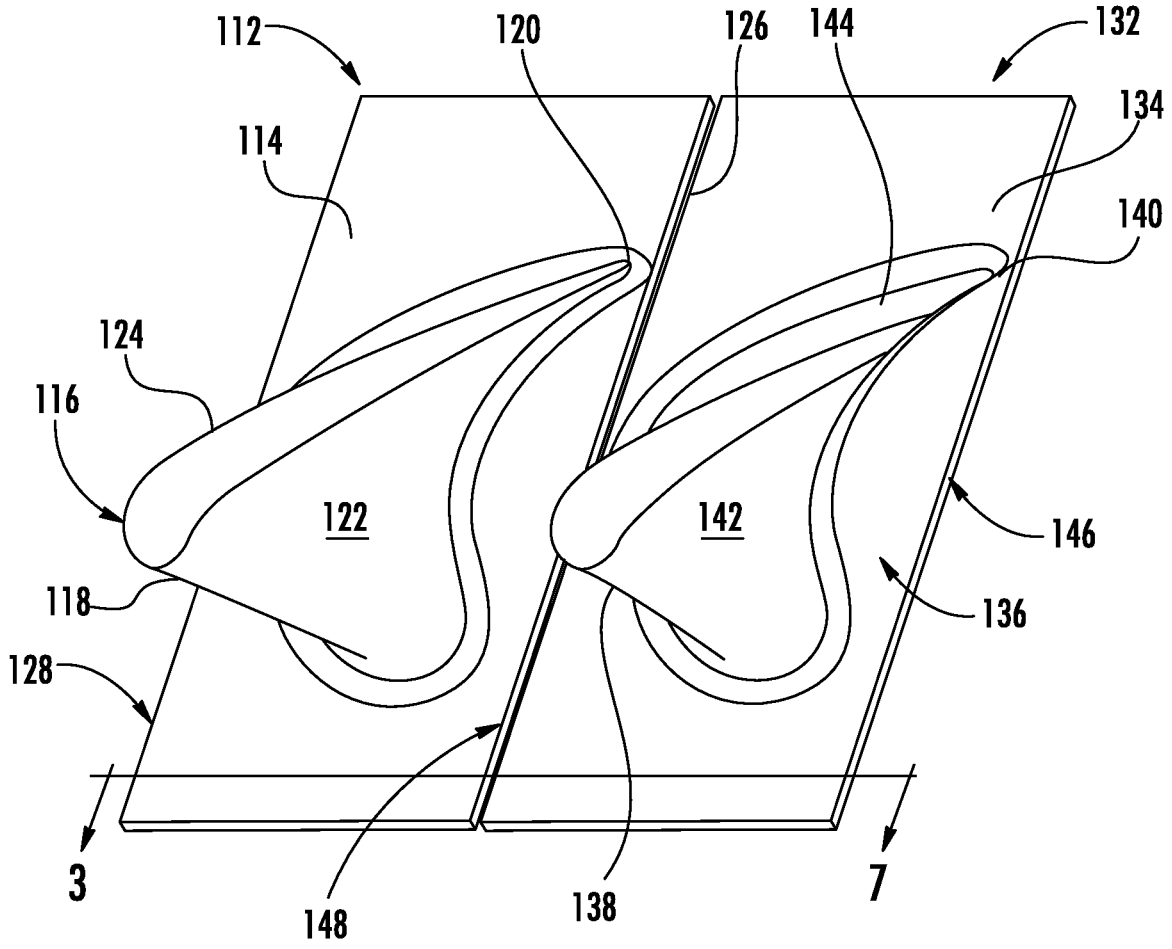
FIG. 2 is a top, perspective diagram depicting representative turbomachinery hardware used in a rotor assembly from the embodiment of FIG. 1.

FIG. 2 is a top, perspective diagram depicting representative turbomachinery hardware used in a rotor assembly of the embodiment of FIG. 1. In particular, FIG. 2 depicts turbomachinery hardware 112 and an adjacent turbomachinery hardware 132. As shown in FIG. 2, each turbomachinery hardware 112 includes an platform 114 that supports an airfoil portion 116. The airfoil portion 116 includes a leading edge 118, a trailing edge 120, a pressure side 122 and a suction side 124. As such, the platform 114 includes a pressure side mateface 126 and a suction side mateface 128. Similarly, each adjacent turbomachinery hardware 132 includes a platform 134 that supports an airfoil portion 136. The airfoil portion includes a leading edge 138, a trailing edge 140, a pressure side 142 and a suction side 144. As such, the platform 134 includes a pressure side mateface 146 and a suction side mateface 148. It will be appreciated that FIG. 2 may also depict turbomachinery hardware used in a stator assembly of the embodiment of FIG. 1.

Figure 3:
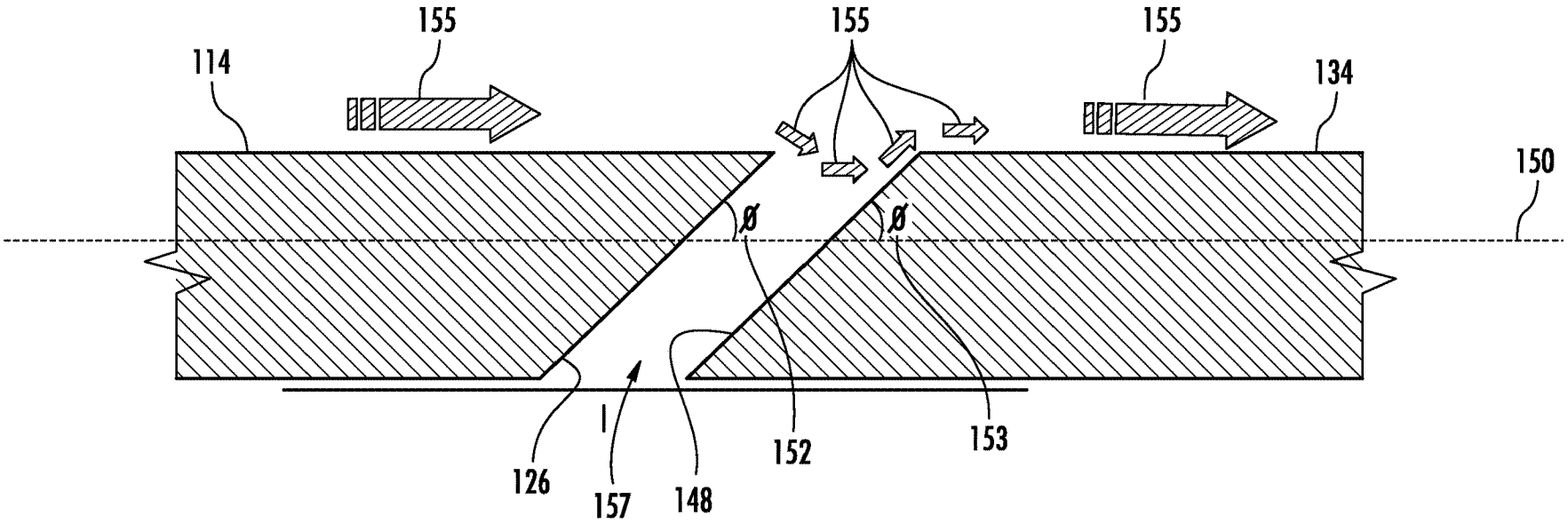
FIG. 3 is a schematic cross-sectional diagram depicting representative turbomachinery hardware from the embodiment of FIG. 2.

FIG. 3 is a cross-sectional diagram depicting representative turbomachinery hardware of the embodiment of FIG. 2. In one embodiment, the platforms 114 and 134 include a platform axis 150. In one embodiment, at least a portion of the pressure side matefaces 126 and 146 includes a first geometry oblique to the platform axis 150. In one embodiment the first geometry includes an angle 152 of less than 90 degrees formed between the pressure side matefaces 126, 146 and the platform axis 150, wherein the angle 152 is measured between the pressure side matefaces 126, 146 and the platform axis 150 in a direction toward an adjacent suction side mateface 128, 148. In one embodiment, the angle 152 formed between the pressure side matefaces 126, 146 and the platform axis 150 may be between approximately 25 degrees and approximately 65 degrees. In one embodiment, at least a portion of the suction side matefaces 128 and 148 includes a second geometry oblique to the platform axis. In one embodiment, the second geometry includes an angle 153 of less than 90 degrees formed between the suction side matefaces 128, 148 and the platform axis 150, wherein the angle 153 is measured between the suction side matefaces 128, 148 and the platform axis 150 in a direction away from an adjacent pressure side mateface 126, 146. In an embodiment, the angle 153 formed between the suction side matefaces 128, 148 and the platform axis 150 may be between approximately 25 degrees and approximately 65 degrees. For example, as the hot gaspath air 155 travels across the platforms 114 and 134, the first geometry of pressure side mateface 126 and the second geometry of the suction side mateface 148 reduces the likelihood of the hot gaspath air 155 entering very deeply into a space 157 between the pressure side mateface 126 and the suction side mateface 148.

Figure 4:
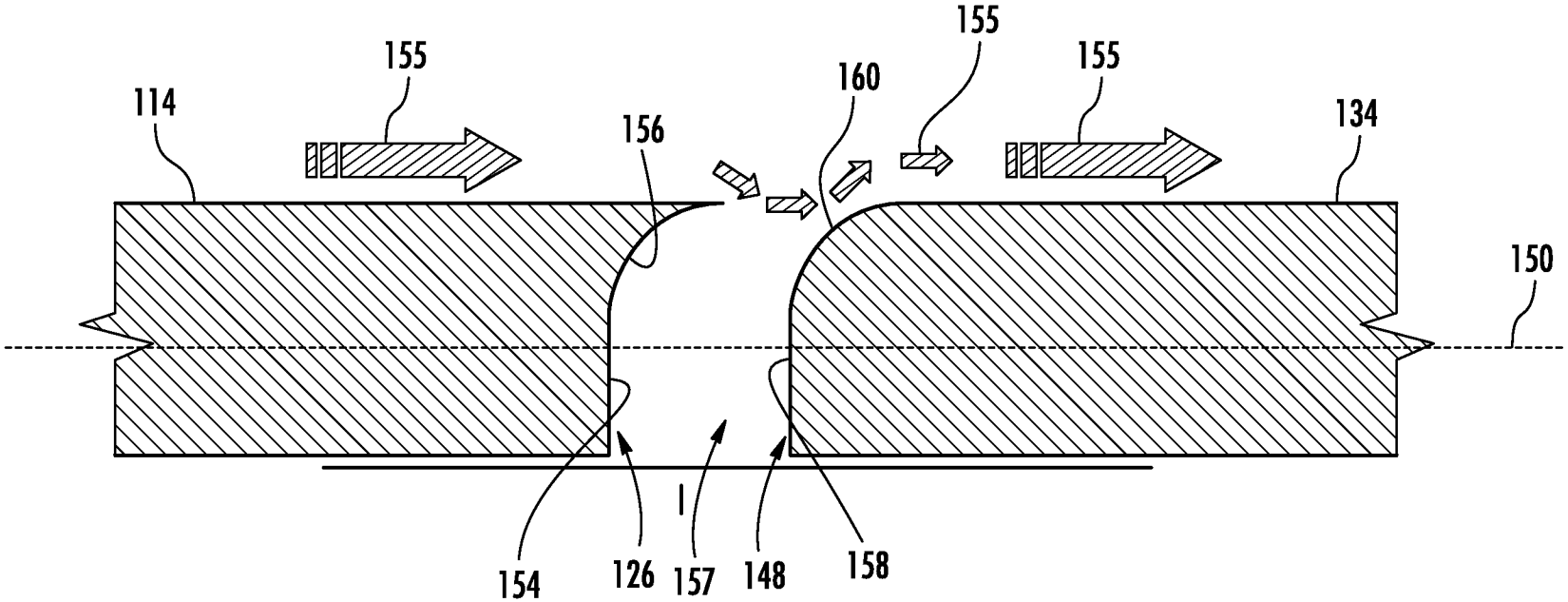
FIG. 4 is a schematic cross-sectional diagram depicting representative turbomachinery hardware from another embodiment of FIG. 2.

In another embodiment, as shown in FIG. 4, at least a portion of the pressure side matefaces 126 and 146 includes a first geometry including a first curved portion 156. In one embodiment, a first straight portion 154 is adjacent to the first curved portion 156. In the embodiment illustrated in FIG. 4, the first straight portion 154 is substantially perpendicular to the platform axis 150. In another embodiment, as shown in FIG. 4, at least a portion of the suction side matefaces 128 and 148 includes a second geometry including a second curved portion 160. In another embodiment, the second geometry further includes a second straight portion 158 adjacent to the second curved portion 160. In the embodiment illustrated in FIG. 4, the second straight portion 158 is substantially perpendicular to the platform axis 150. For example, as the hot gaspath air 155 travels across the platforms 114 and 134, the first geometry of pressure side mateface 126 and the second geometry of the suction side mateface 148 reduces the likelihood of the hot gaspath air 155 entering very deeply into a space 157 between the pressure side mateface 126 and the suction side mateface 148.

Figure 5:
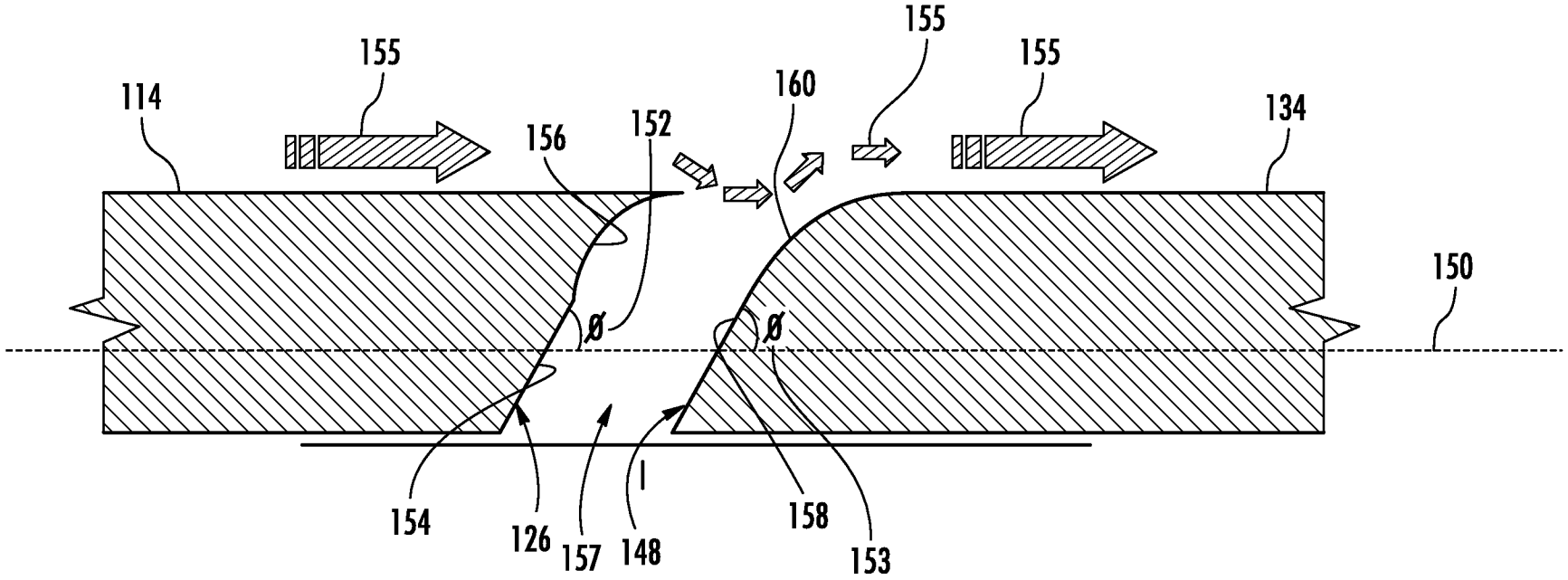
FIG. 5 is a schematic cross-sectional diagram depicting representative turbomachinery hardware from another embodiment of FIG. 2.

In another embodiment, as shown in FIG. 5, at least a portion of the pressure side matefaces 126 and 146 includes a first geometry includes a first curved portion 156. In one embodiment, a first straight portion 154 is adjacent to the first curved portion 156. In the embodiment, illustrated in FIG. 5, an angle 152 less than 90 degrees is formed between the first straight portion 154 of the pressure side matefaces 126, 146 and the platform axis 150. In another embodiment, an angle 152 between approximately 25 degrees and approximately 65 degrees is formed between the first straight portion 154 of the pressure side matefaces 126, 146 and the blade platform axis 150. In another embodiment, at least a portion of the suction side matefaces 128 and 148 includes a second geometry including a second curved portion 160. In another embodiment, the second geometry further includes a second straight portion 158 adjacent to the second curved portion 160. In the embodiment, illustrated in FIG. 5, an angle 153 of less than 90 degrees is formed between the second straight portion 158 of the suction side matefaces 128, 148 and the platform axis 150. In another embodiment, an angle 153 between approximately 25 degrees and approximately 65 degrees is formed between the second straight portion 158 of the suction side matefaces 128, 148 and the platform axis 150.

Figure 6:
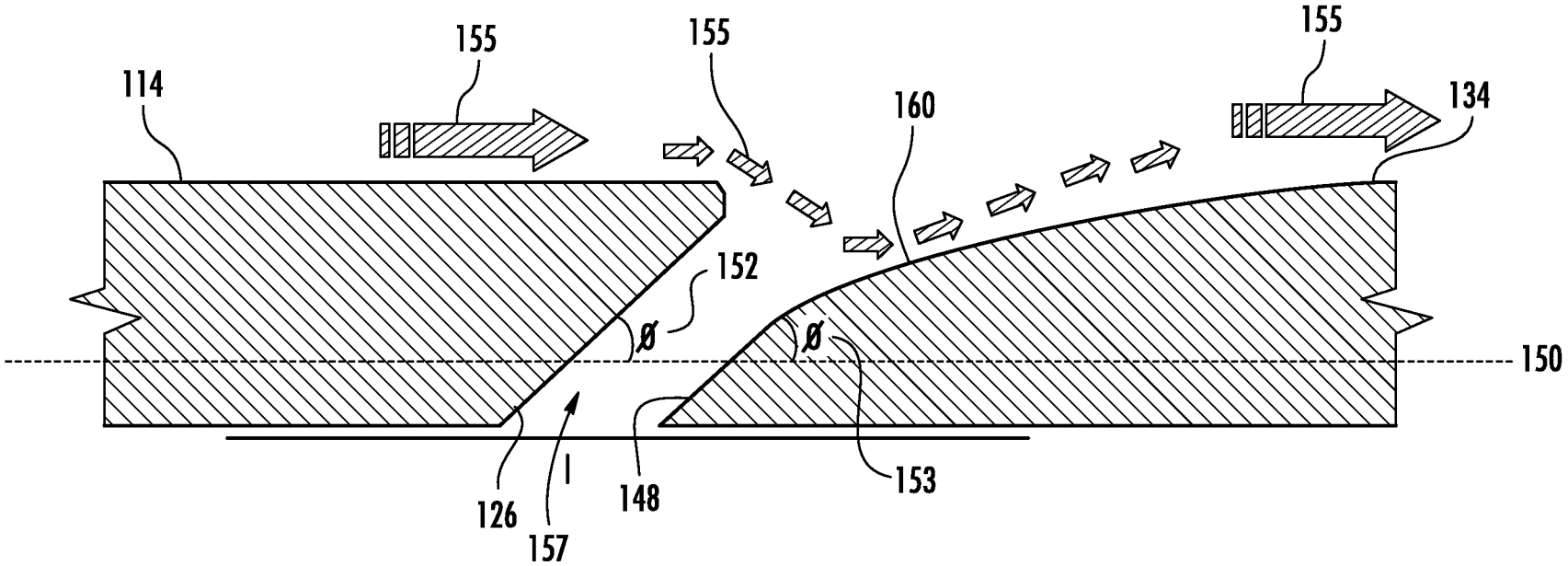
FIG. 6 is a schematic cross-sectional diagram depicting representative turbomachinery hardware from another embodiment of FIG. 2.

In another embodiment, as shown in FIG. 6, at least a portion of the pressure side matefaces 126 and 146 includes a first geometry oblique to the platform axis 150. In one embodiment the first geometry includes an angle 152 of less than 90 degrees formed between the pressure side matefaces 126, 146 and the platform axis 150, wherein the angle 152 is measured between the pressure side matefaces 126, 146 and the platform axis 150 in a direction toward an adjacent suction side mateface 128, 148. In one embodiment, the angle 152 formed between the pressure side matefaces 126, 146 and the platform axis 150 may be between approximately 25 degrees and approximately 65 degrees. In another embodiment, as shown in FIG. 6, at least a portion of the suction side matefaces 128 and 148 includes a second geometry including a second curved portion 160. In another embodiment, the second geometry further includes a second straight portion 158 adjacent to the second curved portion 160. In the embodiment, illustrated in FIG. 6, an angle 153 of less than 90 degrees is formed between the second straight portion 158 of the suction side matefaces 128, 148 and the platform axis 150. In another embodiment, an angle 153 between approximately 25 degrees and approximately 65 degrees is formed between the second straight portion 158 of the suction side matefaces 128, 148 and the platform axis 150.

Figure 7:
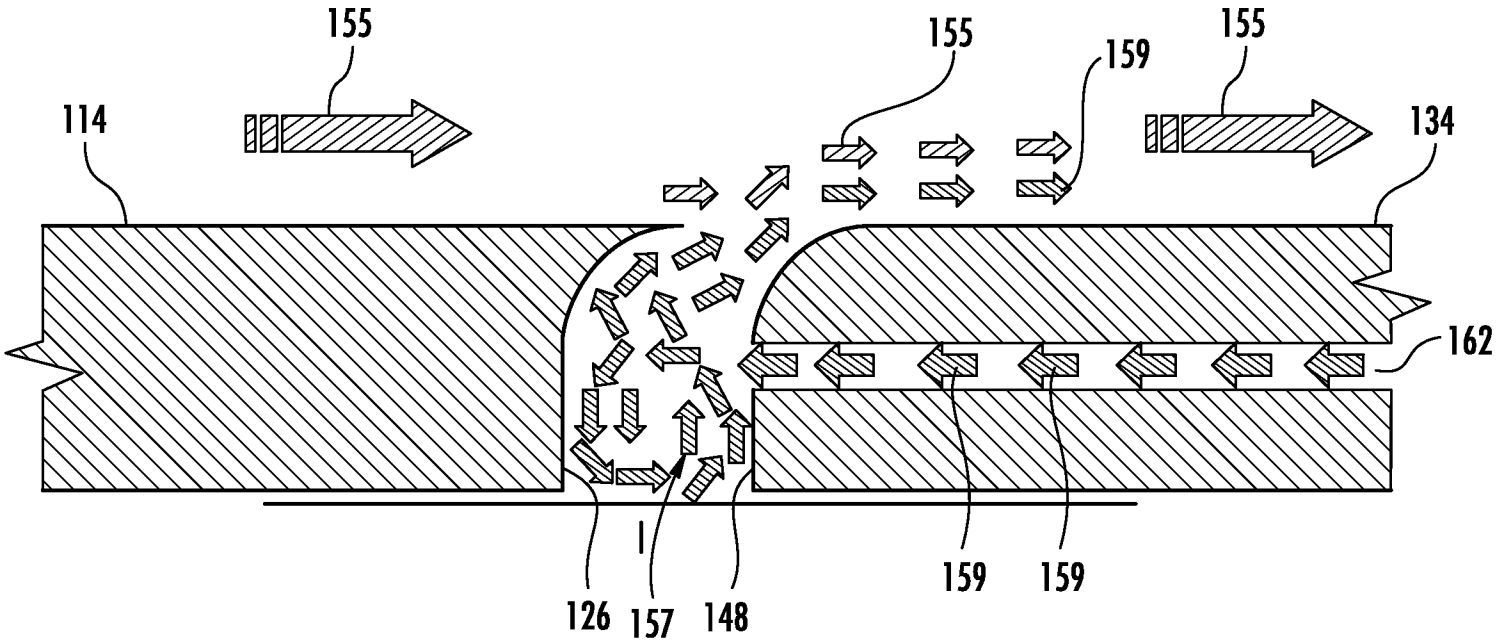
FIG. 7 is a schematic cross-sectional diagram depicting representative turbomachinery hardware from another embodiment of FIG. 2.

In one embodiment, as shown in FIG. 7, at least one interior cooling passage 162 is disposed within the platforms 114 and 134. For example, the at least one interior cooling passage 162 may extend through the suction side matefaces 128 and 148 of the platforms 114 and 134, respectively, for directing cooling air 159 towards the corresponding pressure side matefaces 126 and 146 of the adjacent blade platforms. Routing the cooling air 159 through the at least one interior cooling passages 158 formed in the suction side matefaces 128 and 148, where platform stress tends to be lower than that of the pressure side mateface 126 and 146, reduces stress concentrations of the platform assembly 111. Moreover, based on the first geometry of the pressure side mateface 126 and the second geometry of the suction side mateface 148, the cooling air 159 exits the space 157 at a minimal angle with respect to the gaspath air 155; thus, providing effective cooling to the exterior of platform surface 134.

It will be appreciated from the present disclosure that the embodiments disclosed herein provide for a turbomachinery hardware wherein at least a portion of the pressure side mateface 126, 146 and at least a portion of the suction side mateface 128, 148 include a geometry where the amount of hot gaspath air 155 entering the space 157 between the pressure side matefaces 126, 146 and the suction side matefaces 128, 148 is reduced. In solving the problem in this manner, the performance of the gas turbine engine 100 may be improved.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A turbine assembly comprising:

a rotor comprising a plurality of turbine blades arranged in a circular array; and a stator, adjacent to the rotor, comprising a plurality of turbine vanes arranged in a circular array;

wherein one or more turbine blades, one or more turbine vanes, or one or more of both, comprise:

an airfoil portion including a leading edge, a trailing edge, a pressure side, and a suction side; and a platform on which the airfoil is disposed, each platform having one radial side with one radial exterior surface, and another radial side with another radial exterior surface, each being parallel to a platform axis, wherein the airfoil extends from the one radial exterior surface on the one radial side, the platform including a pressure side mateface located adjacent to the pressure side of the airfoil portion and a suction side mateface located adjacent to the suction side airfoil portion, wherein:

the pressure side mateface is spaced from the suction side mateface along the platform axis to define a mateface channel therebetween, the mateface channel being continuous and unobstructed from the one radial exterior surface on the one radial side of each platform to the other radial exterior surface on other radial side of each platform;

the mateface channel consisting of two radial sides including one radial side extending to the one radial exterior surface of the one radial side of each platform and another radial side extending to the other radial exterior surface of the other radial side of each platform;

the one radial side of the mateface channel consists of:

a first curved portion of the pressure side mateface that is convex; and a second curved portion of the suction side mateface that is concave, whereby the one radial side of the mateface channel consists of an arc shape; and the other radial side of the mateface channel consists of:

a first straight portion of the pressure side mateface; and a second straight portion of the suction side mateface, wherein each straight portion is perpendicular to the platform axis; and the one radial side of the mateface channel smoothly transitions to the other radial side of the mateface channel.

2. A gas turbine engine comprising:

a compressor; and a turbine operative to drive the compressor, wherein the turbine includes a turbine blade assembly;

wherein the turbine blade assembly comprises:

a rotor comprising a plurality of turbine blades arranged in a circular array; and a stator, adjacent to the rotor, comprising a plurality of turbine vanes arranged in a circular array;

wherein one or more turbine blades, one or more turbine vanes, or one or more of both, comprise:

an airfoil portion including a leading edge, a trailing edge, a pressure side, and a suction side; and a platform on which the airfoil is disposed, each platform having one radial side with one radial exterior surface, and another radial side with another radial exterior surface, each being parallel to a platform axis, wherein the airfoil extends from the one radial exterior surface on the one radial side, the platform including a pressure side mateface located adjacent to the pressure side of the airfoil portion and a suction side mateface located adjacent to the suction side airfoil portion, wherein:

the pressure side mateface is spaced from the suction side mateface along the platform axis to define a mateface channel therebetween, the mateface channel being continuous and unobstructed from the one radial exterior surface on the one radial side of each platform to the other radial exterior surface on other radial side of each platform;

the mateface channel consisting of two radial sides including one radial side extending to the one radial exterior exterior surface of the one radial side of each platform and another radial side extending to the other radial exterior surface of the other radial side of each platform;

the one radial side of the mateface channel consists of:

a first curved portion of the pressure side mateface that is convex; and a second curved portion of the suction side mateface that is concave, whereby the one radial side of the mateface channel consists of an arc shape; and the other radial side of the mateface channel consists of:

a first straight portion of the pressure side mateface; and a second straight portion of the suction side mateface, wherein each straight portion is perpendicular to the platform axis; and the one radial side of the mateface channel smoothly transitions to the other radial side of the mateface channel.

3. The assembly of claim 1, wherein the one radial exterior surface of the one radial side of each platform is an outer radial exterior surface of an outer radial side of each platform and the other radial exterior surface of the other radial side of each platform is an inner radial surface of the inner radial side of each platform.

4. The engine of claim 2, wherein the one radial exterior surface of the one radial side of each platform is an outer radial exterior surface of an outer radial side of each platform and the other radial exterior surface of the other radial side of each platform is an inner radial surface of the inner radial side of each platform.

5. The assembly of claim 1, wherein each one radial exterior surface is radially level one another, and each other radial exterior surface is radially level one another.

6. The engine of claim 2, wherein each one radial exterior surface is radially level one another, and each other radial exterior surface is radially level one another.

7. The assembly of claim 1, wherein one of the platforms includes a cooling passage extending parallel to the platform axis.

8. The engine of claim 2, wherein one of the platforms includes a cooling passage extending parallel to the platform axis.

9. The assembly of claim 7, wherein the cooling passage extends through the suction-side mateface.

10. The engine of claim 8, wherein the cooling passage extends through the suction-side mateface.

* * * * *